US005496014A

United States Patent [19]

Hsu

[11] Patent Number: 5,496,014

[45] Date of Patent: Mar. 5, 1996

[54] MOTORIZED SCREW JACK ASSEMBLY

[76] Inventor: Kun-Shan Hsu, No. 3, Ha Ko Liau, Pei Hou Lei, Chia Yi, Taiwan

[21] Appl. No.: 266,487

[22] Filed: Jun. 27, 1994

[51] Int. Cl.[6] ..... B66F 3/22

[52] U.S. Cl. ..... 254/122; 254/103

[58] Field of Search ..... 254/122, 126, 254/DIG. 2

[56] References Cited

U.S. PATENT DOCUMENTS 3,997,143 12/1976 Rose ..... 254/122
5,029,814 7/1991 Liegel et al. ..... 254/122

FOREIGN PATENT DOCUMENTS 4691 3/1915 United Kingdom ..... 254/122

*Primary Examiner*—Robert C. Watson
*Attorney, Agent, or Firm*—Morton J. Rosenberg; David I. Klein

[57] ABSTRACT

A screw jack includes a pair of frames disposed between a pair of walls, a bracket disposed above the beams, and a bolt engaged between the lower ends of the frames. An actuating device is engaged with the bolt and includes a motor for rotating the bolt so as to move the lower ends of the frames toward each other or away from each other and so as to elevate the bracket. The bracket can be easily move up and down by the motorized actuating device.

2 Claims, 5 Drawing Sheets

MOTORIZED SCREW JACK ASSEMBLY

BACKGROUND OF THE INVENTION

1. Field of the Invention

The present invention relates to a jack, and more particularly to a motorized screw jack assembly.

2. Description of the Prior Art

Typical screw jacks comprise a handle for driving a bolt element so as to elevate an object. However, it will be difficult for most women to operate the handle. In addition, the elevational speed of the screw jack is slow.

The present invention has arisen to mitigate and/or obviate the afore-described disadvantages of the conventional screw jacks.

SUMMARY OF THE INVENTION

The primary objective of the present invention is to provide a screw jack which is motorized such that the screw jack can be easily operated.

In accordance with one aspect of the invention, there is provided a jack assembly comprising a pair of wall members fixed together in parallel with each other and each including two horizontal grooves and a vertical groove arranged between the horizontal grooves; a pair of frames including a middle portion pivotally coupled together at a shaft, the shaft including two ends slidably engaged in the vertical grooves of the wall members, the pair of frames including two lower ends and two upper ends, two blocks pivotally secured to the lower ends of the pair of beams at two axles, the first axles including end portions slidably engaged in the horizontal grooves; a bolt engaged through the blocks; a bracket; a pair of arms including lower ends pivotally coupled to the upper ends of the frames and upper ends pivotally coupled to the bracket; and means for actuating the bolt so as to move the blocks toward each other or away from each other in order to move the bracket upward or downward.

The upper ends of the arms includes a plurality of teeth formed therein and engaged with each other. The actuating means includes a housing, a motor disposed in the housing, engaging means for engaging with the bolt, and gearing means coupling the motor to the engaging means so as to rotate the bolt.

The gearing means includes a first gear secured to the motor, a sleeve fixed in the housing and having a first internal gear formed therein, at least one first disc having at least one first pinion rotatably engaged thereon, the first pinion being engaged with the first gear and engaged with the first internal gear, a second gear secured to the first disc, a second disc including at least one second pinion rotatably engaged thereon, the second pinion being engaged with the second gear and engaged with the first internal gear, the second disc including a second internal gear formed therein; the engaging means includes a third gear engaged with the second internal gear, and a head having an engaging surface formed therein for engaging with the bolt.

The housing includes a pair of channels formed in parallel therein and includes a ring having a pair of ears engaged in the channels, the ring includes a center hole for engaging with the first gear and an annular slot for engaging with the sleeve, the sleeve includes a pair of lugs engaged in the channels so as to prevent the sleeve from rotating in the housing.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
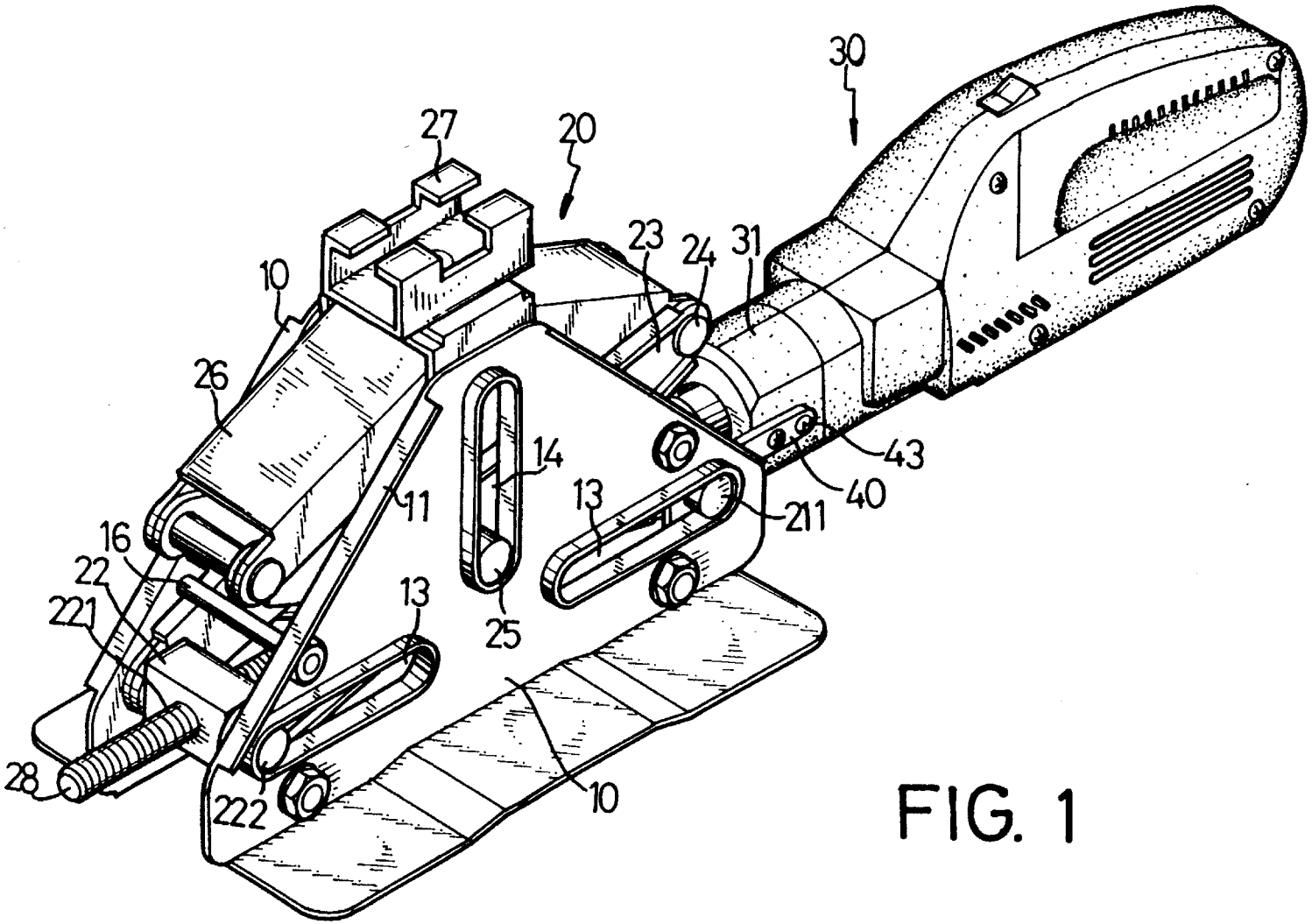
FIG. 1 is a perspective view of a motorized screw jack in accordance with the present invention.
Figure 2:
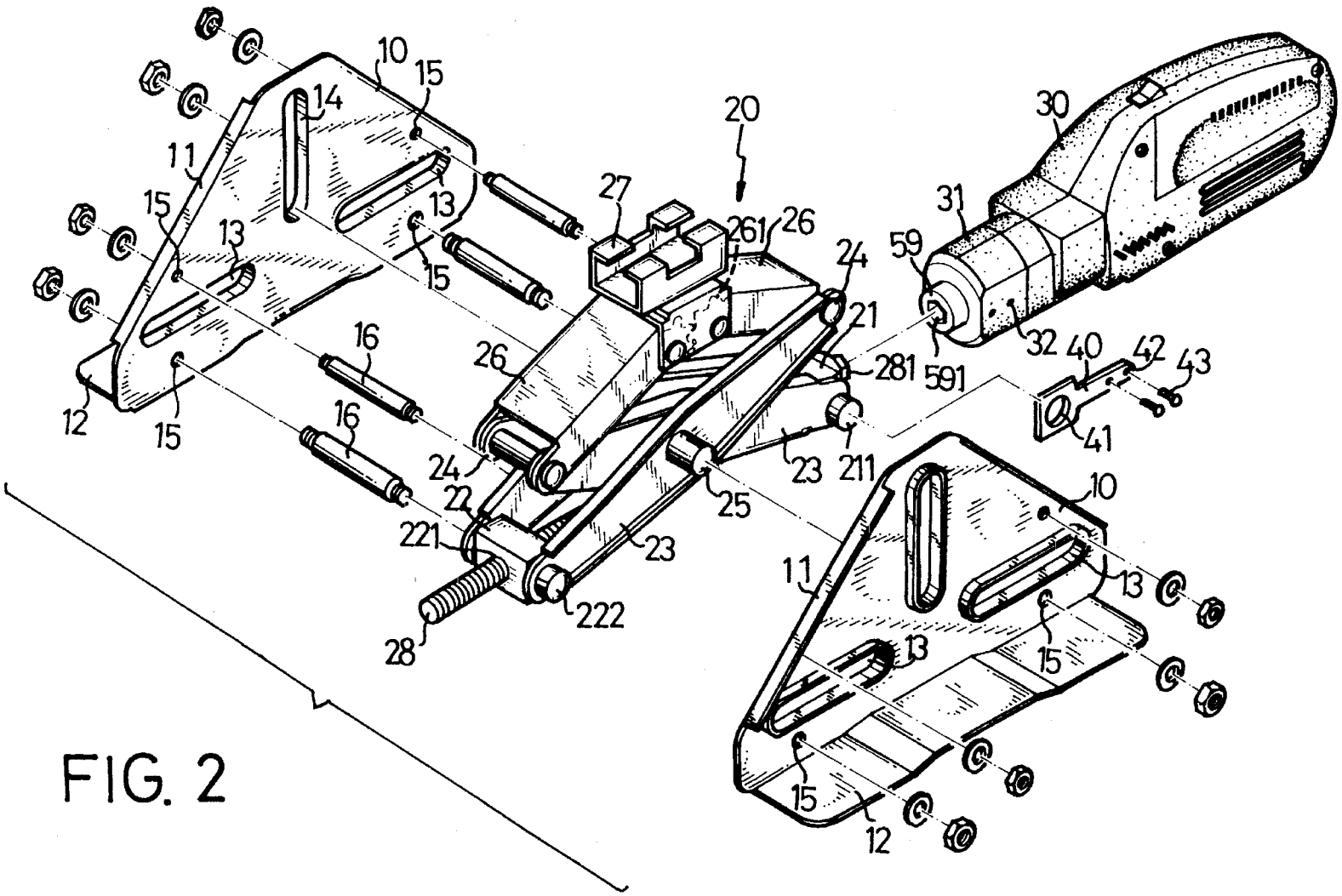
FIG. 2 is an exploded view of the screw jack.
Figure 3:
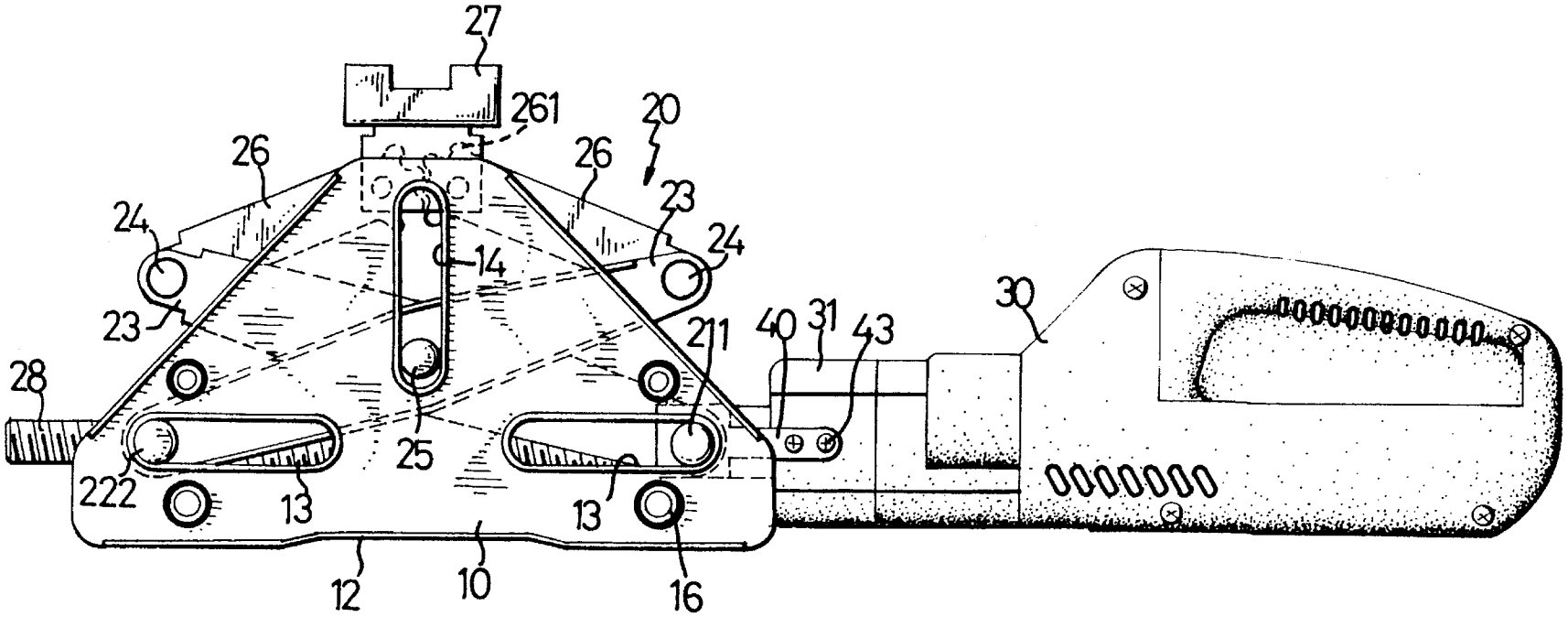
FIGS. 3 and 4 are plane views illustrating the operation of the screw jack.

Referring to the drawings, and initially to FIGS. 1 to 3, a motorized screw jack in accordance with the present invention comprises a pair of wall members 10 each including a pair of flanges 11 provided on upper portion thereof for reinforcing purposes and each including a base 12 for engaging with the supporting surface, such as floor. Each of the wall members 10 includes two horizontal grooves 13 and a vertical groove 14 arranged between the horizontal grooves 13. The wall members 10 include a number of holes 15 formed therein for engaging with bolts 16 so as to secure the wall members 10 together.

An elevating mechanism 20 includes a pair of frames 23 having a middle portion pivotally coupled together at a shaft 25 which includes two ends slidably engaged in the vertical grooves 14. Each of the frames 23 includes two beams having upper ends and lower ends coupled together by axles 24, 211, 222. Two blocks 21, 22 are pivotally secured to the lower ends of the beams at the axles 211, 222. Block 22 has a screw hole 221 formed therein for engaging with a bolt 28, the other block 21 has an opening for rotatably engaging with the bolt 28 such that the bolt 28 is freely rotatable in the opening of the block 21. The bolt 28 includes a head 281 formed on one end. A pair of arms 26 include lower ends pivotally coupled to the upper ends of the beams 23 at the axles 24 and include a plurality of teeth 261 formed in the upper ends for engaging with one another. The upper ends of the arms 26 are pivotally coupled to a bracket 27 which is provided for engaging with the object to be elevated.

Figure 5:
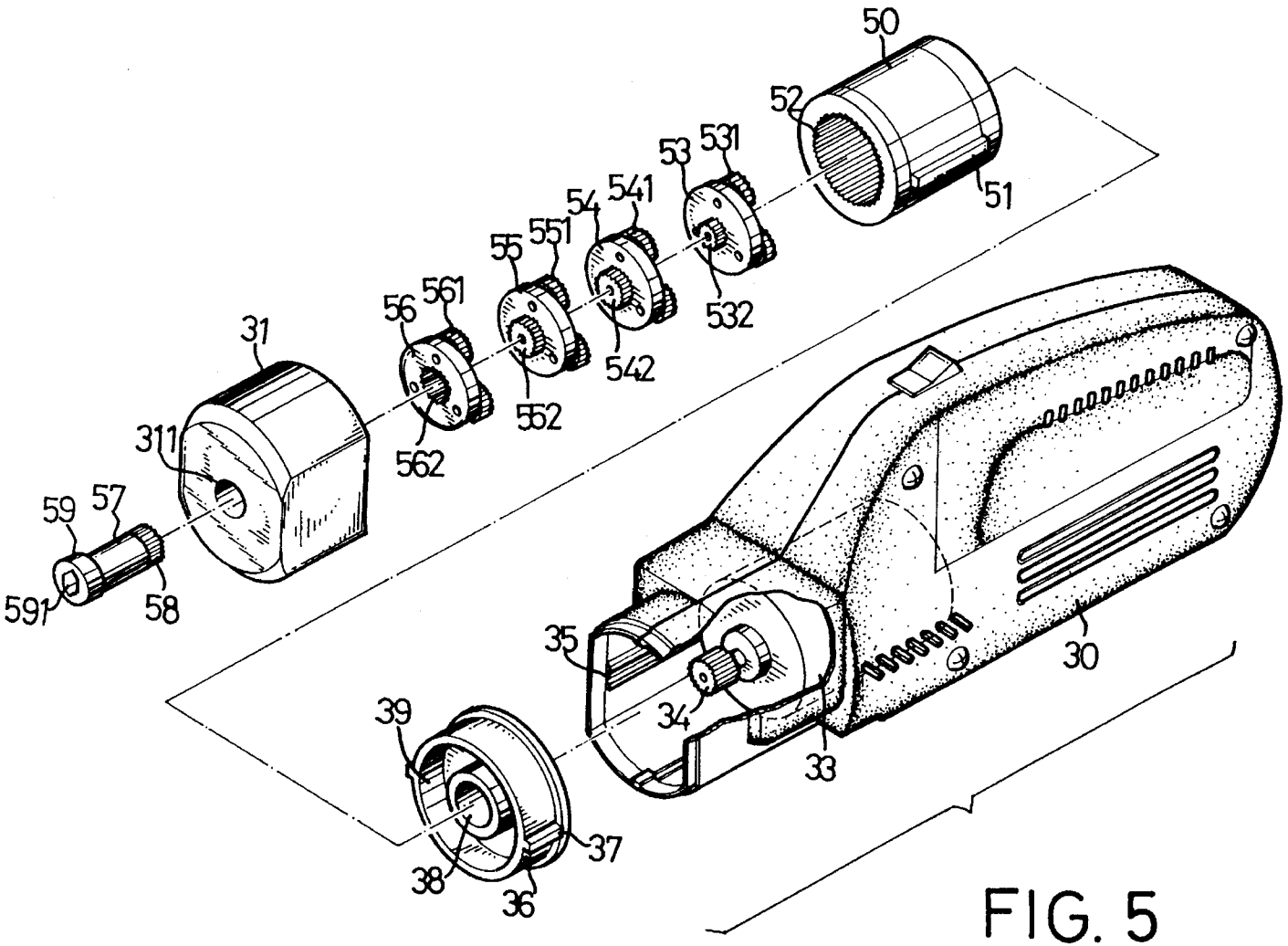
FIG. 5 is an exploded view illustrating the actuating means.

Referring next to FIG. 5, and again to FIG. 2, an actuating mechanism includes a body or a housing 30 having a cap 31 fixed to the front end. The cap 31 includes two screw holes 32 formed in one side thereof. A lever 40 includes an aperture 4 formed in one end for rotatably engaging with the axle 211 and includes two holes 42 formed in the other end for engaging with two screws 43 which engage with the screw holes 32 of the cap 31 so as to secure the lever 40 to the cap 31. The actuating mechanism includes a motor 33 disposed in the housing 30. The motor 33 includes a gear 34 secured thereto. A pair of channels 35 are formed in parallel in the front portion of the housing 30. A ring 36 includes a pair of ears 37 for engaging with the channels 35 and includes a center hole 38 and an annular slot 39 formed therein. A sleeve 50 includes a pair of lugs 51 for slidably engaging with the channels 35 and includes an internal gear 52 formed therein. Four discs 53, 54, 55, 56 are engaged in the sleeve 50 and each includes three pinions 531, 541, 551, 561 rotatably secured thereto and engaged with the internal gear 52 of the sleeve 50. The gear 34 of the motor 33 extends through the center hole 38 of the ring 36 and engages with the pinions 531 of the disc 53 such that the disc 53 can be rotated by the gear 34. The discs 53, 54, 55 each includes gear 532, 542, 552 for engaging with the pinions 541, 551, 561. The disc 56 includes an internal gear 562 formed therein. The cap 31 includes a center hole 311 formed therein. A rod 57 includes a gear 58 formed on one end and extended through the center hole 311 of the cap 31 and engaged with the internal gear 562 of the disc 56, and includes an enlarged head 59 formed in the other end and having an engaging surface 591 formed therein for engaging with the head 281 of the bolt 28, such that the bolt 28 can be rotated by the motor 33. The head 59 is maintained in engagement with the bolt head 281 by the lever 40.

Figure 4:
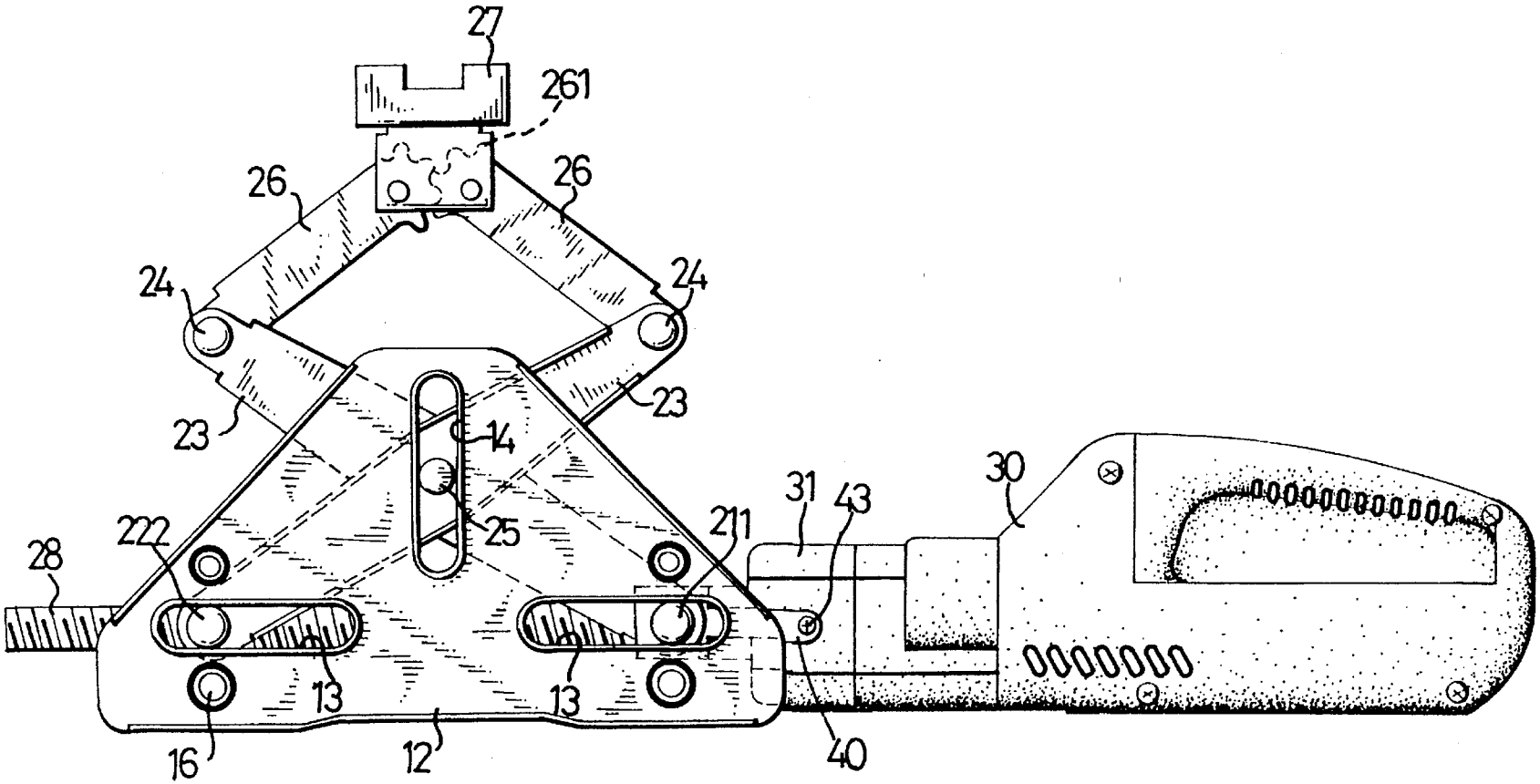

In operation, as shown in FIG. 4, when the bolt 28 is rotated, the blocks 21, 22 can be caused to move toward each other or to move away from each other. When the blocks 21, 22 move toward each other, the bracket 27 is moved upward, and the bracket 27 moves downward when the blocks 21, 22 move away from each other. The shaft 25 is guided to move upward and downward along the vertical groove 14 such that the screw jack can be suitably centered. As best shown in FIG. 4, the actuating mechanism may move in concert with the block 21, and the cap 11 has a size small enough to move inwards of the space between the two wall members 10.

Accordingly, the motorized screw jack in accordance with the present invention can be easily operated with the motorized actuating mechanism.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A jack assembly comprising:

a pair of wall members fixed together in parallel with each other and each including two horizontal grooves and a vertical groove arranged between said horizontal grooves;

a pair of frames including a middle portion pivotally coupled together at a shaft, said shaft including two ends slidably engaged in said vertical grooves of said wall members, said pair of frames including two lower ends and two upper ends, two blocks pivotally secured to said lower ends of said pair of beams at two axles, a first axle of said two axles including end portions slidably engaged in said horizontal grooves;

a bolt engaged through said blocks;

a bracket;

a pair of arms including lower ends pivotally coupled to said upper ends of said frames and upper ends pivotally coupled to said bracket; and means for actuating said bolt so as to move said blocks toward each other or away from each other in order to move said bracket upward or downward, said actuating means including a housing, a motor disposed in said housing, engaging means for engaging with said bolt, and gearing means coupling said motor to said engaging means so as to rotate said bolt; said gearing means including a first gear secured to said motor, a sleeve fixed in said housing and having a first internal gear formed therein, at least one first disc having at least one first pinion rotatably engaged thereon, said first pinion being engaged with said first gear and engaged with said first internal gear, a second gear secured to said first disc, a second disc including at least one second pinion rotatably engaged thereon, said second pinion being engaged with said second gear and engaged with said first internal gear, said second disc including a second internal gear formed therein; said engaging means including a third gear engaged with said second internal gear, and a head having an engaging surface formed therein for engaging with said bolt.

2. A jack assembly according to claim 1, wherein said housing includes a pair of channels formed in parallel therein and includes a ring having a pair of ears engaged in said channels, said ring includes a center hole for engaging with said first gear and an annular slot for engaging with said sleeve, said sleeve includes a pair of lugs engaged in said channels so as to prevent said sleeve from rotating in said housing.

* * * * *